US010186811B1

(12) United States Patent
Trout et al.

(10) Patent No.: US 10,186,811 B1
(45) Date of Patent: Jan. 22, 2019

(54) SHIELDING FOR CONNECTOR ASSEMBLY

(71) Applicant: TE CONNECTIVITY CORPORATION, Berwyn, PA (US)

(72) Inventors: David Allison Trout, Lancaster, PA (US); Douglas Edward Shirk, Elizabethtown, PA (US); Sean Patrick McCarthy, Palmyra, PA (US); Justin Dennis Pickel, Hummelstown, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/832,864

(22) Filed: Dec. 6, 2017

(51) Int. Cl.
*H01R 13/6588* (2011.01)
*H01R 13/506* (2006.01)
*H01R 13/428* (2006.01)

(52) U.S. Cl.
CPC ..... *H01R 13/6588* (2013.01); *H01R 13/428* (2013.01); *H01R 13/506* (2013.01)

(58) Field of Classification Search
CPC ... H01R 13/514; H01R 13/248; H01R 13/506
See application file for complete search history.

(56) References Cited

U.S. PATENT DOCUMENTS 8,382,522 B2 2/2013 Glover et al.
8,419,472 B1 * 4/2013 Swanger ..... H01R 13/6587 439/607.07
8,444,434 B2 5/2013 Davis et al.
8,500,487 B2 8/2013 Morgan et al.
8,662,924 B2 3/2014 Davis et al.
8,888,530 B2 11/2014 Trout et al.
8,894,442 B2 * 11/2014 McClellan ..... H01R 13/6587 439/607.05
8,992,252 B2 * 3/2015 McClellan ..... H01R 13/6587 439/108
9,608,382 B2 * 3/2017 McClellan ..... H01R 13/6587
9,666,991 B2 5/2017 Davis
2013/0273781 A1 * 10/2013 Buck ..... H01R 13/516 439/626
2014/0148054 A1 * 5/2014 Annis ..... H01R 13/514 439/607.05
2014/0194004 A1 * 7/2014 Pickel ..... H01R 13/6587 439/607.01
2016/0072231 A1 * 3/2016 Sypolt ..... H01R 13/6585 439/607.08

* cited by examiner

*Primary Examiner* — Briggitte R Hammond

(57) ABSTRACT

A receptacle connector assembly includes a contact module having signal contacts and ground contacts and a housing having a front shell and a rear shell coupled to the front shell. The front shell and the rear shell receive the signal contacts and corresponding header signal contacts of a header connector assembly in mating engagement with the signal contacts in a mating zone. The front shell and the rear shell receive the ground contacts and corresponding header ground contacts of the header connector assembly in mating engagement with the ground contacts in the mating zone. The rear shell has pockets receiving corresponding signal contacts and ground contacts. The rear shell has conductors at the front of the rear shell providing electrical shielding in the mating zone.

21 Claims, 8 Drawing Sheets

SHIELDING FOR CONNECTOR ASSEMBLY

BACKGROUND OF THE INVENTION

The subject matter herein relates generally to shielding for connector assemblies.

Some electrical systems utilize connector assemblies, such as header connector assemblies and receptacle connector assemblies, to interconnect two circuit boards, such as a motherboard and daughtercard. The connector assemblies include signal contacts and ground contacts. The ground contacts of the header and receptacle connector assemblies are mated to provide grounded electrical shielding for the signal contacts. High speed connector assemblies suffer from problems with cross talk and can exhibit higher than desirable return loss due to geometries of the signal and ground contacts. For example, at high data rates, noise resonance issues occur in the mating area between the header and receptacle connector assemblies.

A need remains for a connector assembly having improved electrical shielding.

BRIEF DESCRIPTION OF THE INVENTION

In one embodiment, a receptacle connector assembly is provided including at least one contact module having signal contacts and ground contacts and a housing having a front shell and a rear shell receiving the at least one contact module. The front shell has a front and a rear and the rear shell having a front and a rear with the front of the rear shell engaging the rear of the front shell. The front of the front shell defines a mating end of the housing configured for mating with a header connector assembly. The front shell and the rear shell receive the signal contacts and are configured to receive corresponding header signal contacts of the header connector assembly in mating engagement with the signal contacts in a mating zone. The front shell and the rear shell receive the ground contacts and are configured to receive corresponding header ground contacts of the header connector assembly in mating engagement with the ground contacts in the mating zone. The rear shell has pockets receiving corresponding signal contacts and ground contacts. The rear shell has conductors at the front of the rear shell providing electrical shielding in the mating zone.

In another embodiment, a receptacle connector assembly is provided including at least one contact module having signal contacts and ground contacts and a housing having a front shell and a rear shell receiving the at least one contact module. The front shell has a front and a rear and the rear shell has a front and a rear with the front of the rear shell engaging the rear of the front shell. The rear shell has separating walls defining pockets. The rear shell receives the at least one contact module such that the signal contacts and the ground contacts extend into corresponding pockets. The front of the front shell defines a mating end of the housing configured for mating with a header connector assembly. The front shell has signal contact openings receiving corresponding signal contacts and configured to receive corresponding header signal contacts of the header connector assembly in mating engagement with the signal contacts. The front shell has ground contact openings receiving corresponding ground contacts and configured to receive corresponding header ground contacts of the header connector assembly in mating engagement with the ground contacts. The rear shell has clips at the front of the rear shell. The clips are conductive. Each clip has a base and a mating beam extending from the base. The mating beam extends into the corresponding pocket and is configured to engage and be electrically coupled to the corresponding header ground contact of the header connector assembly received in the corresponding pocket.

In a further embodiment, an electrical connector system is provided including a header connector assembly and a receptacle connector assembly. The header connector assembly has a header housing holding header signal contacts and header ground contacts having shield walls extending to distal ends of the header ground contacts. The receptacle connector assembly has at least one contact module having signal contacts and ground contacts and a housing having a front shell and a rear shell holding the at least one contact module. The front shell has a front and a rear and the rear shell has a front and a rear with the front of the rear shell engaging the rear of the front shell. The front of the front shell defines a mating end of the housing mated with the header housing. The front shell and the rear shell receive the signal contacts and the ground contacts of the at least one contact module. The front shell and the rear shell receive the header signal contacts and the header ground contacts of the header connector assembly in mating engagement with the respective signal contacts and the respective ground contacts. The rear shell has pockets receiving corresponding signal contacts and ground contacts. The rear shell has conductors at the front of the rear shell being electrically coupled to the header ground contacts remote from the front of the front shell.

DETAILED DESCRIPTION OF THE INVENTION

Figure 1:
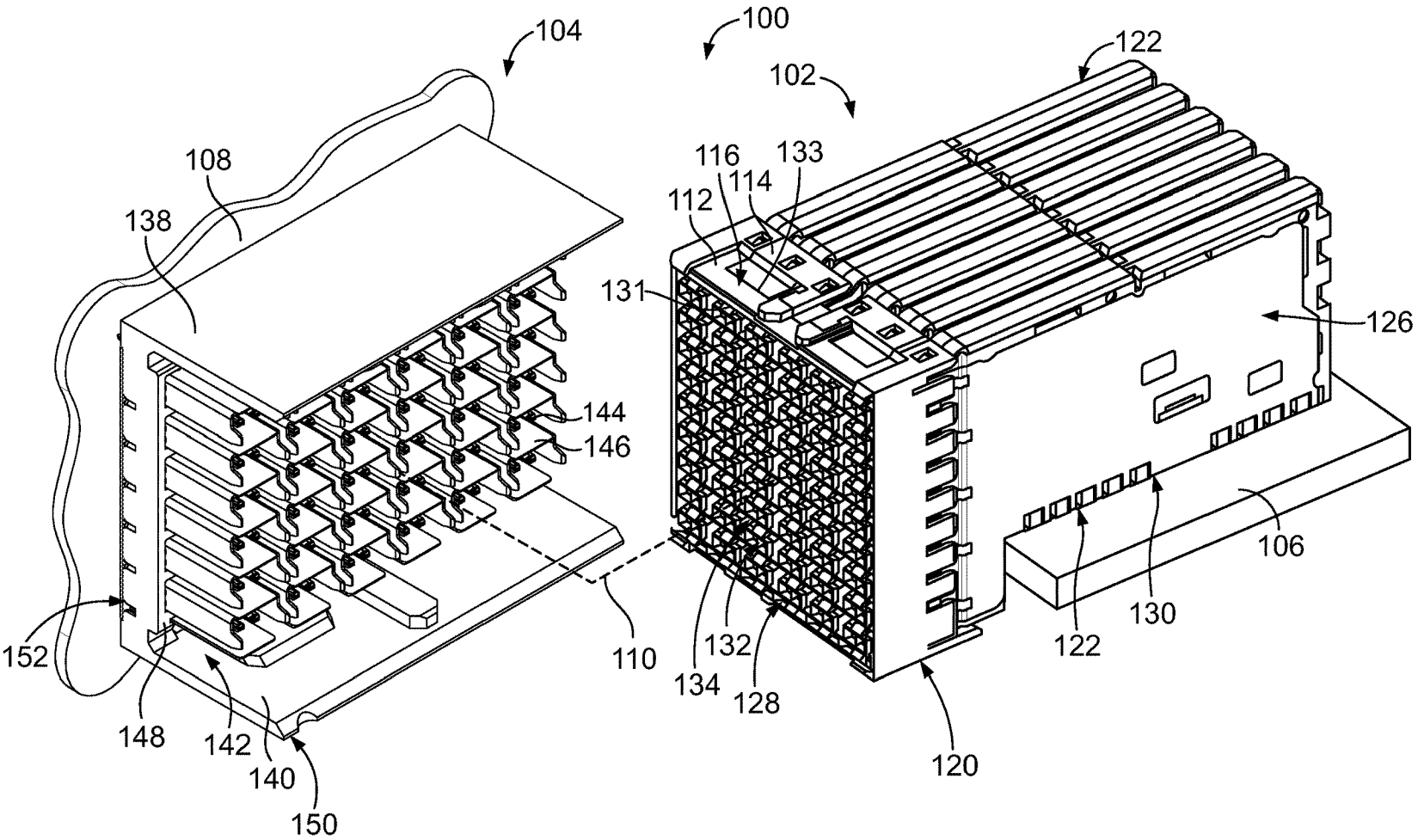
FIG. 1 is a perspective view of an electrical connector system including a header connector assembly and a receptacle connector assembly formed in accordance with an exemplary embodiment.

FIG. 1 is a perspective view of an electrical connector system 100 formed in accordance with an exemplary embodiment. The connector system 100 includes a receptacle connector assembly 102 and a header connector assembly 104. Other types of connector assemblies may be used in alternative embodiments, such as vertical connectors, right angle connectors or other types of connector. The receptacle and header connector assemblies 102, 104 are electrically connected to respective circuit boards 106, 108. The receptacle and header connector assemblies 102, 104 are utilized to electrically connect the circuit boards 106, 108 to one another at a separable mating interface. In an exemplary embodiment, the circuit boards 106, 108 are oriented perpendicular to one another when the receptacle and header connector assemblies 102, 104 are mated. Alternative orientations of the circuit boards 106, 108 are possible in alternative embodiments. A mating axis 110 extends through the receptacle and header connector assemblies 102, 104. The receptacle and header connector assemblies 102, 104 are mated together in a direction parallel to and along the mating axis 110.

The receptacle connector assembly 102 includes a housing 120 that holds one or more contact modules 122. In an exemplary embodiment, the housing 120 is a multi-piece housing having a front shell 112 and a rear shell 114 that meet at an interface 116. The interface 116 may be provided at a mating zone of the housing 120 where signal contacts and ground contacts of the connector assemblies 102, 104 mate. The contact modules 122 are held in a stacked configuration generally parallel to one another. Any number of contact modules 122 may be provided in the receptacle connector assembly 102. The contact modules 122 each include a plurality of signal contacts 124 (shown in FIG. 2) that define signal paths through the receptacle connector assembly 102. The signal contacts 124 may be arranged in pairs configured to carry differential signals.

The receptacle connector assembly 102 includes a mating end 128 at a front of the receptacle connector assembly 102, such as defined by the front shell 112, and a mounting end 130 at a bottom of the receptacle connector assembly 102. The mating and mounting ends 128, 130 may be at different locations other than the front and bottom in alternative embodiments. The signal contacts 124 (shown in FIG. 2) are received in the housing 120 and held therein at the mating end 128 for electrical termination to the header connector assembly 104. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the pairs of signal contacts 124 are arranged in rows (pair-in-row arrangement); however, in alternative embodiments, the pairs of signal contacts 124 may be arranged in the same column (pair-in-column arrangement). The signal contacts 124 extend through the receptacle connector assembly 102 from the mating end 128 to the mounting end 130 for mounting to the circuit board 106. Optionally, the mounting end 130 may be oriented substantially perpendicular to the mating end 128.

In an exemplary embodiment, each contact module 122 has a shield structure 126 for providing electrical shielding for the signal contacts 124. The contact modules 122 may generally provide 360° shielding for each pair of signal contacts 124 along substantially the entire length of the signal contacts 124 between the mounting end 130 and the mating end 128. In an exemplary embodiment, the shield structure 126 is electrically connected to the header connector assembly 104 and/or the circuit board 106. For example, the shield structure 126 may be electrically connected to the header connector assembly 104 by ground contacts 125 (shown in FIG. 2) (for example, beams and/or fingers) extending from the contact modules 122 that engage the header connector assembly 104. The shield structure 126 may be electrically connected to the circuit board 106 by ground contacts, such as ground pins. In an exemplary embodiment, a portion of the shield structure 126 on one side of the contact module 122 is electrically connected to a portion of the shield structure 126 on another side of the contact module 122. For example, portions of the shield structure 126 on opposite sides of the contact module 122 may be electrically connected to each other by internal extensions (for example tabs) that extend through the interior of the contact module 122. Having the portions of the shield structure 126 on opposite sides of the contact module 122 electrically connected to each other electrically commons the portions of the shield structure 126 to provide increased performance of the signal transmission through the contact module 122.

In an exemplary embodiment, embodiments provided herein provide electrical commoning of the shield structure 126 at various locations along the shield paths to enhance the effectiveness of the shield structure 126. For example, various embodiments may provide electrical commoning of the shield structure at or near the mating interface between the receptacle and header connector assemblies 102, 104. Various embodiments may provide electrical commoning at a location interior of the housing 120 of the receptacle connector assembly 102, such as at or near the interface 116 between the front and rear shells 112, 114 of the housing 120.

The front shell 112 extends between a front 131 and a rear 133. The front 131 may define the mating end 128 of the receptacle connector assembly 102. In an exemplary embodiment, the front shell 112 is manufactured from a dielectric material, such as a plastic material. The front shell 112 includes a plurality of signal contact openings 132 and a plurality of ground contact openings 134 extending between the front 131 and the rear 133. The signal contacts 124 are received in corresponding signal contact openings 132. Optionally, a single signal contact 124 is received in each signal contact opening 132. The signal contact openings 132 may also receive corresponding header signal contacts 144 therein when the receptacle and header connector assemblies 102, 104 are mated. The ground contacts 125 are received in corresponding ground contact openings 134. Optionally, a plurality of ground contacts 125 are received in each ground contact opening 134. The ground contact openings 134 are sized and shaped to receive header ground contacts 146 therein when the receptacle and header connector assemblies 102, 104 are mated. For example, in the illustrated embodiment, the header ground contacts 146 are C-shaped and the ground contact openings 134 have a complementary C-shape. The ground contact openings 134 receive the ground contacts 125 of the shield structure 126 of the contact modules 122 that mate with the header ground contacts 146 to electrically common the receptacle and header connector assemblies 102, 104. The dielectric material of the front shell 112 separates the signal contact openings 132 and the ground contact openings 134 to isolate the signal contacts 124 and the header signal contacts 144 from the ground contacts 125 and the header ground contacts 146.

In an exemplary embodiment, the rear shell 114 includes one or more conductors 136 (shown in FIG. 2) providing electrical shielding in the mating zone of the housing 120. The conductors 136 may be electrically coupled to the ground contacts 125 and/or the header ground contacts 146. For example, the conductors 136 may directly electrically engage the ground contacts 125 and/or the header ground contacts 146 and may electrically connect two or more of the ground contacts 125 and/or the header ground contacts 146 together at a location remote from other areas where the ground contacts 125 and/or the header ground contacts 146 are electrically connected (for example in the contact modules 122 or in the header connector assembly 104) to change the resonance frequency of the shield structure 126 at or near the interface 116, such as in the mating zone. The conductors 136 may reduce noise being transmitted between signal lines. In other various embodiments, the conductors 136 may be capacitively or inductively coupled to the ground contacts 125 and/or the header ground contacts 146 to change the resonance frequency of the shield structure 126 at or near the interface 116.

The header connector assembly 104 includes a header housing 138 having walls 140 defining a chamber 142. The header connector assembly 104 has a mating end 150 and a mounting end 152 that is mounted to the circuit board 108. Optionally, the mounting end 152 may be substantially parallel to the mating end 150. The receptacle connector assembly 102 is configured to be received in the chamber 142 through the mating end 150. The housing 120 engages the walls 140 to hold the receptacle connector assembly 102 in the chamber 142. The header signal contacts 144 and the header ground contacts 146 extend from a base wall 148 into the chamber 142 for mating with the receptacle connector assembly 102.

The header ground contacts 146 provide electrical shielding around corresponding header signal contacts 144. The header signal contacts 144 may be arranged in rows and columns on the header connector assembly 104. In an exemplary embodiment, the header signal contacts 144 are arranged in pairs configured to convey differential signals. The header ground contacts 146 peripherally surround a corresponding pair of the header signal contacts 144 to provide electrical shielding. In the illustrated embodiment, the header ground contacts 146 are C-shaped, covering three sides of the pair of header signal contacts 144; however other shapes are possible in alternative embodiments, such as L-shaped or a plurality of individual beams on one or more sides of the header signal contacts 144.

Figure 2:
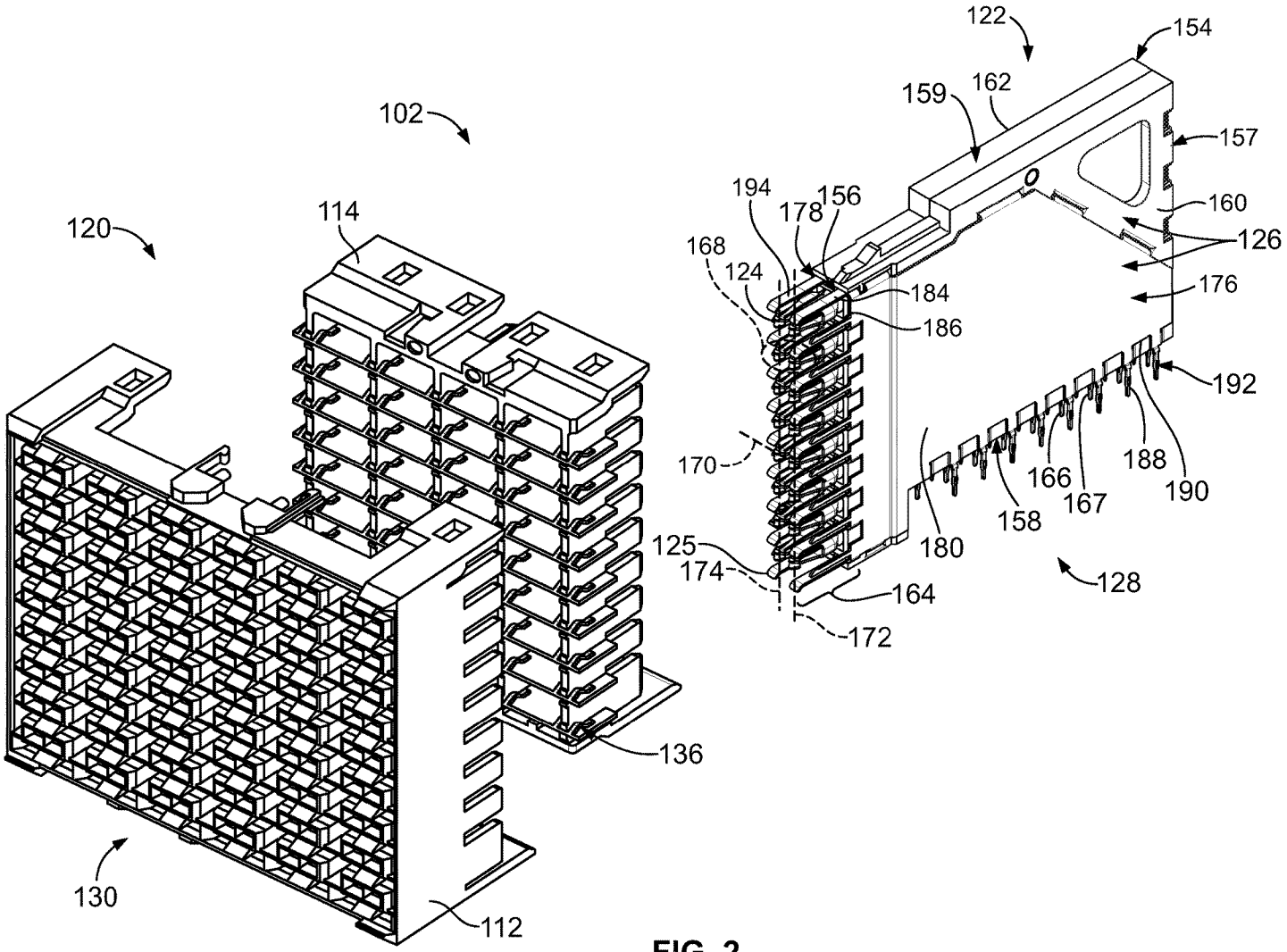
FIG. 2 is an exploded view of the receptacle connector assembly in accordance with an exemplary embodiment showing a contact module thereof.
Figure 3:
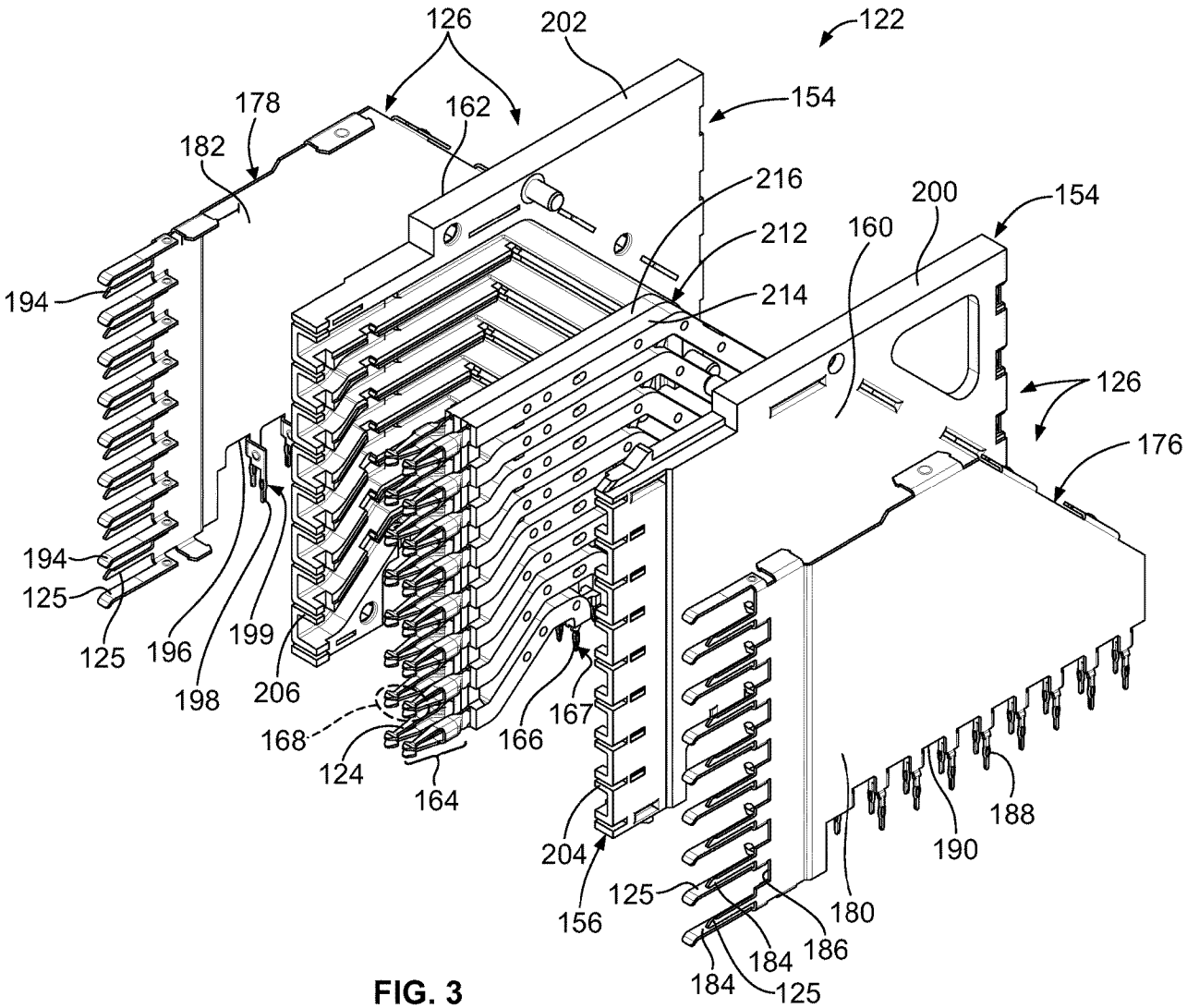
FIG. 3 is an exploded perspective view of the contact module shown in FIG. 2.

FIG. 2 is an exploded view of the receptacle connector assembly 102 showing one of the contact modules 122 poised for loading into the housing 120. FIG. 3 is an exploded perspective view of the contact module 122. Any number of contact modules 122 may be loaded side-by-side and parallel to each other in a stacked configuration.

In an exemplary embodiment, the contact module 122 includes a conductive holder 154, which defines at least a portion of the shield structure 126. The conductive holder 154 generally surrounds the signal contacts 124 along substantially the entire length of the signal contacts 124 between the mounting end 130 and the mating end 128. The conductive holder 154 has a front 156 configured to be loaded into the rear shell 114 of the housing 120, a rear 157 opposite the front 156, a bottom 158 that faces the circuit board 106 (shown in FIG. 1), and a top 159 generally opposite the bottom 158. The bottom 158 of the conductive holder 154 may define a bottom of the contact module 122. The bottom 158 of the conductive holder 154 may define the mounting end 130 of the receptacle connector assembly 102. The conductive holder 154 also defines right and left exterior sides 160, 162, as viewed from the front.

The conductive holder 154 is fabricated from a conductive material, which provides electrical shielding for the receptacle connector assembly 102. For example, the conductive holder 154 may be die-cast, or alternatively stamped and formed, from a metal material. In other alternative embodiments, the holder 154 may be fabricated from a plastic material that has been metalized or coated with a metallic layer. In other embodiments, rather than a conductive holder, the holder 154 may be non-conductive. In other embodiments, the contact module 122 may be provided without the conductive holder 154 altogether.

The signal contacts 124 have mating portions 164 extending forward from the front 156 of the conductive holder 154. The mating portions 164 are configured to be electrically terminated to corresponding header signal contacts 144 (shown in FIG. 1) when the receptacle connector assembly 102 and header connector assembly 104 (shown in FIG. 1) are mated. In an exemplary embodiment, the other ends of the signal contacts 124 extend downward from the bottom 158 of the conductive holder 154 as signal pins 166. The signal pins 166 electrically connect the contact module 122 to the circuit board 106 (shown in FIG. 1). The signal pins 166 are configured to be terminated to the circuit board 106. For example, the signal pins 166 may be through-hole mounted to the circuit board 106. The signal pins 166 may be compliant pins, such as eye-of-the-needle pins. For example, the signal pins 166 have enlarged areas that are configured to engage corresponding plated vias of the circuit board 106 by an interference fit to mechanically and electrically couple the signal pins 166 to the circuit board 106. Optionally, in some embodiments, at least some of the pins may be ground pins that are part of ground contacts forming part of the shield structure 126. In the illustrated embodiment, the mating portions 164 extend generally perpendicular with respect to the signal pins 166; however, other orientations are possible in alternative embodiments.

In an exemplary embodiment, the signal contacts 124 in each contact module 122 are arranged as contact pairs 168 configured to transmit differential signals through the contact module 122. The signal contacts 124 within each contact pair 168 are arranged in rows that extend along row axes 170. In an exemplary embodiment, each row axis 170 includes one contact pair 168 from each contact module 122 stacked together in the receptacle connector assembly 102. At the mating end 128, the contact pairs 168 within each contact module 122 are stacked vertically. The right signal contacts 124 of each contact module 122 extend along a column axis 172, and the left signal contacts 124 of each contact module extend along a column axis 174. When the contact modules 122 are stacked in the receptacle connector assembly 102, the column axes 172, 174 of the contact modules 122 extend parallel to each other. In other embodiments, the contact pairs 168 may be arranged in-column rather than in-row.

In an exemplary embodiment, each contact module 122 includes first and second ground shields 176, 178, which define at least a portion of the shield structure 126. The ground shields 176, 178 may be positioned along the exterior sides 160, 162 of the conductive holder 154. For example, the first ground shield 176 may be positioned along the right side 160 of the conductive holder 154, and as such, may be hereinafter referred to as the right ground shield 176. The second ground shield 178 (FIG. 3) may be positioned along the left side 162 of the conductive holder, and may be hereinafter referred to as the left ground shield 178. The ground shields 176, 178 are configured to provide electrical shielding for the signal contacts 124. The ground contacts 125 extend from the ground shields 176, 178 to electrically connect the contact module 122 to the header ground contacts 146 (shown in FIG. 1), thereby electrically commoning the connection across the receptacle connector assembly 102 and header connector assembly 104 (shown in FIG. 1). Optionally, a single ground shield may be used rather than two ground shields. Alternatively, the contact module 122 may not include any ground shields. In various embodiments, the ground contacts 125 are electrically coupled to the conductors 136 (FIG. 2).

The right ground shield 176 is coupled to the right exterior side 160 of the conductive holder 154. When attached to the conductive holder 154, the right ground shield 176 electrically connects to the conductive holder 154. The right ground shield 176 includes a main body 180 that is generally planar and extends alongside of the conductive holder 154. The ground shield 176 includes grounding beams 184 extending from a front 186 of the main body 180 defining corresponding ground contacts 125. The ground shield 176 includes ground pins 188 extending from a bottom 190 of the main body 180. The ground pins 188 are configured to be terminated to the circuit board 106 (shown in FIG. 1). For example, the ground pins 188 may be through-hole mounted to the circuit board 106. The ground pins 188 may be compliant pins, such as eye-of-the-needle pins.

The left ground shield 178 (FIG. 3) may be similar to the right ground shield 176. The left ground shield 178 may be a mirrored version of the right ground shield 176. The left ground shield 178 is coupled to the left exterior side 162 of the conductive holder 154. The left ground shield 178 includes a main body 182 that is generally planar and extends alongside of the conductive holder 154. The ground shield 178 includes grounding beams 194 extending from a front of the main body 182 defining corresponding ground contacts 125. The ground shield 178 includes ground pins 198 extending from a bottom 196 of the main body 182. The ground pins 198 are configured to be terminated to the circuit board 106 (shown in FIG. 1). For example, the ground pins 198 may be through-hole mounted to the circuit board 106. The ground pins 198 may be compliant pins, such as eye-of-the-needle pins.

In an exemplary embodiment, the right and left ground shields 176, 178 are manufactured from a metal material. The ground shields 176, 178 are stamped and formed parts with the grounding beams 184, 194 being stamped and then formed during a forming process. The ground pins 188, 198 are stamped and/or formed.

The conductive holder 154 shown in the illustrated embodiment includes a right holder member 200 and a left holder member 202. Upon assembling the contact module 122, the right and left holder members 200, 202 are coupled together to form the conductive holder 154. The right and left ground shields 176, 178 are coupled to the right and left holder members 200, 202, respectively. The right ground shield 176 engages and is electrically connected to the right holder member 200. The left ground shield 178 (FIG. 3) engages and is electrically connected to the left holder member 202. In various embodiments, the ground shields 176, 178 and/or the holder members 200, 202 may be electrically connected together through the interior of the contact module 122.

As a part of the shield structure 126, the holder members 200, 202 generally provide electrical shielding between and around respective signal contacts 124. For example, the holder members 200, 202 provide shielding from electromagnetic interference (EMI) and/or radio frequency interference (RFI), and may provide shielding from other types of interference as well. The holder members 200, 202 may provide shielding around the outside of the signal contacts 124 as well as between the signal contacts 124 using tabs 204, 206. As a result, the holder members 200, 202 allow for better control of electrical characteristics, such as impedance, cross-talk, resonance control, and the like, of the signal contacts 124.

The conductive holder 154 holds a frame assembly 212, which includes the signal contacts 124. Upon assembly of the contact module 122, the frame assembly 212 is received in the right and left holder members 200, 202. The holder members 200, 202 provide shielding around the frame assembly 212 and signal contacts 124. The tabs 204, 206 are configured to extend into the frame assembly 212 such that the tabs 204, 206 are positioned between signal contact pairs 168 to provide shielding between adjacent contact pairs 168.

The frame assembly 212 includes a pair of right and left dielectric frames 214, 216, respectively, surrounding and supporting the signal contacts 124. In an exemplary embodiment, one of the signal contacts 124 of each contact pair 168 is held by the right dielectric frame 214, while the other signal contact 124 of the contact pair 168 is held by the left dielectric frame 216. The signal contacts 124 of each contact pair 168 extend through the frame assembly 212 generally along parallel paths such that the signal contacts 124 are skewless between the mating portions 164 and the signal pins 166.

In an exemplary embodiment, the signal contacts 124 are initially held together as leadframes (not shown), which are overmolded with dielectric material to form the dielectric frames 214, 216. Manufacturing processes other than overmolding a leadframe may be utilized to form the dielectric frames 214, 216, such as loading signal contacts 124 into a formed dielectric body. In various alternative embodiments, the ground shields 176 and/or 178 may be coupled directly to the dielectric frames 214, 216 without the need for the conductive holder 154.

Figure 4:
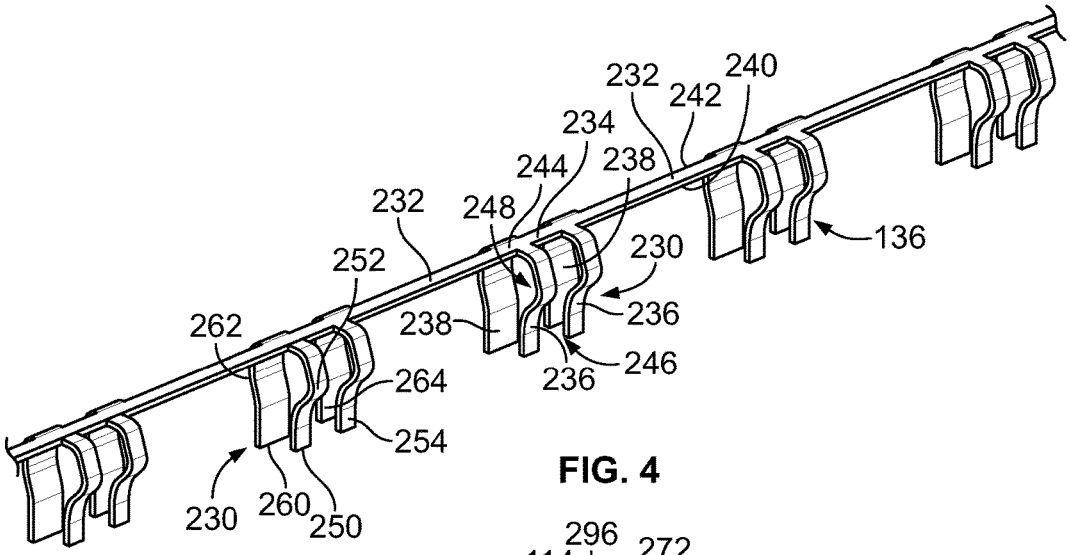
FIG. 4 is a perspective view of a conductor of the receptacle connector assembly in accordance with an exemplary embodiment.

FIG. 4 is a perspective view of the conductors 136 in accordance with an exemplary embodiment. In an exemplary embodiment, the conductors 136 include clips 230 configured to be coupled to the rear shell 114 (shown in FIG. 2). In the illustrated embodiment, the clips 230 are connected by connecting bars 232. The connecting bars 232 space the clips 230 apart for mounting to the rear shell 114. In alternative embodiments, the clips 230 may be removed from the connecting bars 232. In an exemplary embodiment, the clips 230 and the connecting bars 232 are stamped and formed from a sheet of metal. The clips 230 are separate from the rear shell 114 and configured to be coupled to the rear shell 114 for electrical connection with the header ground contacts 146 (shown in FIG. 1).

Each clip 230 includes a base 234 and one or more mating beams extending from the base 234. For example, in the illustrated embodiment, each clip 230 includes a pair of upper mating beams 236 and a pair of lower mating beams 238. The upper mating beams 236 extend from a top 240 of the base 234. The lower mating beams 238 extend from a bottom 242 of the base 234. In an exemplary embodiment, the base 234 is provided at a front 244 of the clip 230 and the mating beams 236, 238 extend rearward from the base 234. The upper mating beams 236 are separated by a gap 246 and the lower mating beams 238 are separated by a gap 248. In an exemplary embodiment, the upper mating beams 236 are aligned with the lower mating beams 238 such that the gaps 246, 248 are aligned. Each upper mating beam 236 extends from the base 234 to a distal end 250. The upper mating beam 236 includes a mating interface 252 along the mating beam 236. In the illustrated embodiment, the upper mating beam 236 includes a pad 254 rearward of the mating interface 252, such as at or near the distal end 250. Each lower mating beam 238 extends from the base 234 to a distal end 260. The lower mating beam 238 includes a mating interface 262 along the mating beam 238. In the illustrated embodiment, the lower mating beam 238 includes a pad 264 rearward of the mating interface 262, such as at or near the distal end 260.

Figure 5:
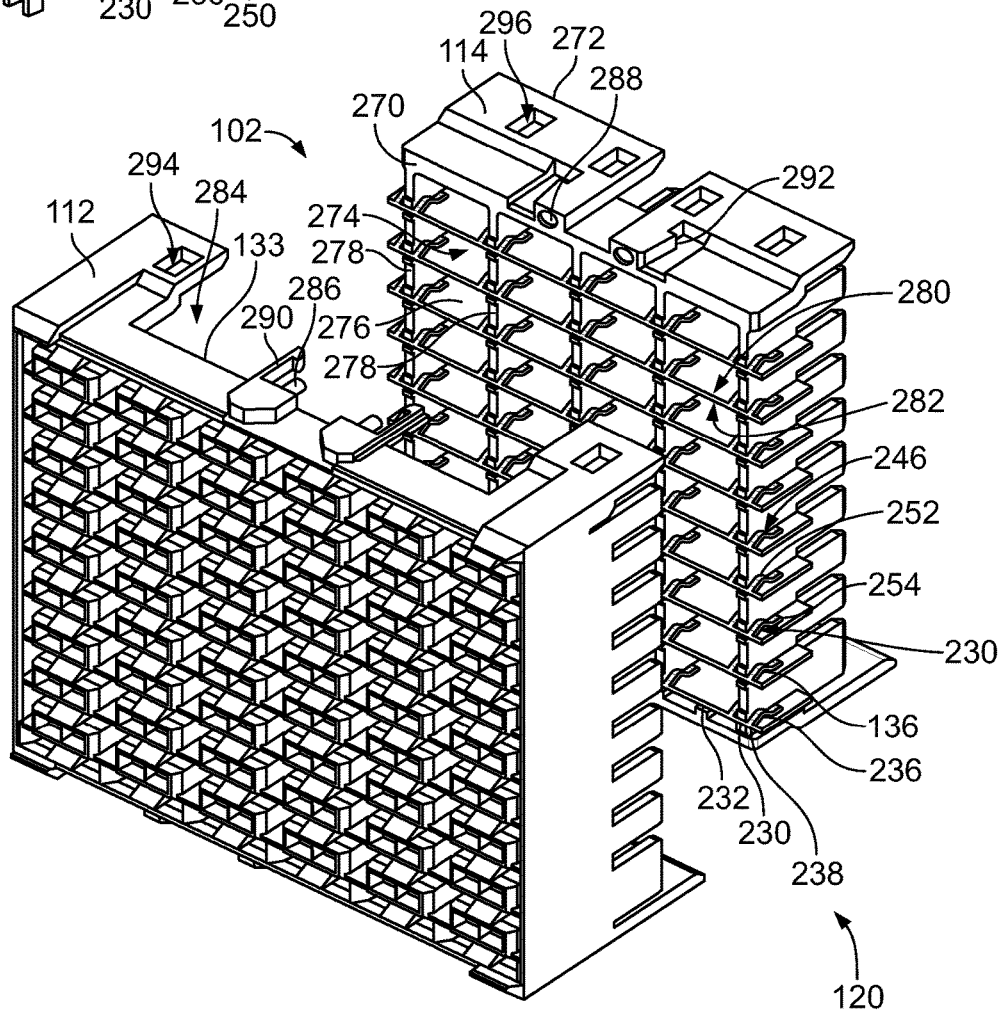
FIG. 5 is a front, exploded view of a portion of the receptacle connector assembly showing front and rear shells with conductors in accordance with an exemplary embodiment.

FIG. 5 is a front, exploded view of a portion of the receptacle connector assembly 102 showing the front and rear shells 112, 114 with the conductors 136 along the rear shell 114. The rear shell 114 includes a front 270 and a rear 272. The rear shell 114 includes a plurality of pockets 274 extending between the front 270 and the rear 272. The rear shell 114 includes horizontal separating walls 276 and vertical separating walls 278 defining the pockets 274.

The clips 230 are coupled to the rear shell 114 such that the mating beams 236, 238 extend into corresponding pockets 274. For example, the bases 234 extend along the horizontal separating walls 276 and the mating beams 236, 238 extend from the bases 234 into the pockets 274. The connecting bars 232 may extend along the horizontal separating walls 276. In an exemplary embodiment, the upper mating beams 236 extend along upper surfaces 280 of the horizontal separating walls 276 and the lower mating beams 238 extend along lower surfaces 282 of the horizontal separating walls 276. The upper mating beams 236 extend into the pockets 274 located above the horizontal separating walls 276 and the lower mating beams 238 extend into the pockets 274 located below the horizontal separating walls 276. As such, each clip 230 extends into different pockets 274 for electrical connection with different header ground contacts 146 (shown in FIG. 1).

In an exemplary embodiment, the mating beams 236, 238 extend along corresponding vertical separating walls 278. For example, the vertical separating walls 278 are received in the gaps 246 between the upper mating beams 236 and the gaps 248 between the lower mating beams 238. Optionally, the pads 254 may rest on the upper surfaces 280 and the pads 264 may rest against the lower surfaces 282. The mating beams 236, 238 may be bowed away from the upper surface 280 and the lower surface 282 for engaging the header ground contacts 146. For example, the mating interfaces 252, 262 may be spaced apart from the upper surfaces 280 and the lower surfaces 282. In an exemplary embodiment, the mating beams 236, 238 are deflectable toward the horizontal separating walls 276 when engaged by the header ground contacts 146.

In an exemplary embodiment, the front shell 112 includes a cavity 284 at the rear 133. The rear shell 114 is configured to be at least partially received in the cavity 284. The front shell 112 includes locating features 286 and the rear shell 114 includes locating features 288 for locating the front shell 112 relative to the rear shell 114. In the illustrated embodiment, the locating features 286 are posts and the locating features 288 are openings that receive the posts. Other types of locating features 286, 288 may be provided in alternative embodiments. The front shell 112 includes latching features 290 and the rear shell 112 includes latching features 292 for securing the front shell 112 to the rear shell 114. In the illustrated embodiment, the latching features 290 are deflectable latches and the latching features 292 are catches that receive the latches. Other types of latching features 290, 292 may be provided in alternative embodiments. The front shell 112 includes contact module latching features 294 and the rear shell 114 includes contact module latching features 296 for securing corresponding contact modules 122 (shown in FIG. 2) in the housing 120. In the illustrated embodiment, the contact module latching features 294, 296 are openings in and walls of the front and rear shells 112, 114 that receive latches of the contact modules 122 to secure the contact modules 122 to the front and rear shells 112, 114. Other types of latching features may be used in alternative embodiments.

Figure 6:
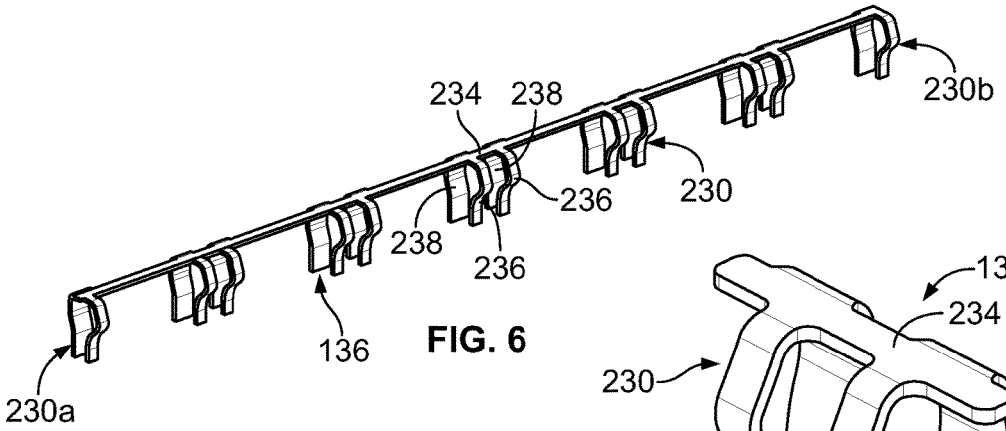
FIG. 6 is a perspective view of the conductors in accordance with an exemplary embodiment.

FIG. 6 is a perspective view of the conductors 136 in accordance with an exemplary embodiment. The conductors 136 are similar to the conductors 136 shown in FIG. 4; however, in the illustrated embodiment, the conductors 136 do not include the pads 254, 264 (FIG. 4). The conductors 136 are in the form of the clips 230. The upper and lower mating beams 236, 238 are shorter in the embodiment illustrated in FIG. 6. The upper and lower mating beams 236, 238 are configured to be cantilevered from the base 234 rather than rest on the horizontal separating walls 276 (shown in FIG. 5). The mating forces between the receptacle connector assembly 102 and the header connector assembly 104 may be reduced by using cantilevered mating beams 236, 238 rather than mating beams 236, 238 that rest on the horizontal separating walls 276.

In the illustrated embodiment, the outermost clips 230*a*, 230*b* include single upper and lower mating beams 236, 238 rather than pairs of upper mating beams 236 and pairs of lower mating beams 238. The outermost clips 230*a*, 230*b* may be positioned interior of the outermost walls of the rear shell 114 in the outermost pockets 274.

Figure 7:
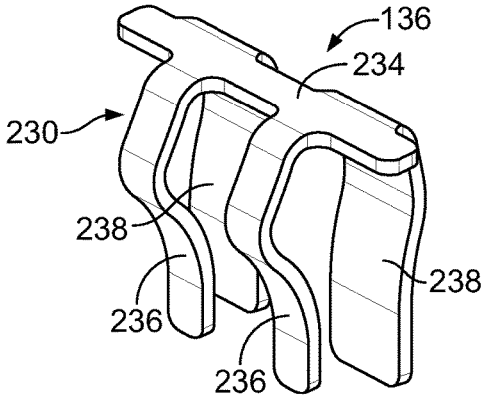
FIG. 7 is a perspective view of a conductor in accordance with an exemplary embodiment.

FIG. 7 is a perspective view of one of the conductors 136 in accordance with an exemplary embodiment. The conductor 136 illustrated in FIG. 7 is a single clip 230 rather than having a series of clips 230 connected by the connecting bars 232 shown in FIG. 4. The clip 230 includes the base 234 and the mating beams 236, 238.

Figure 8:
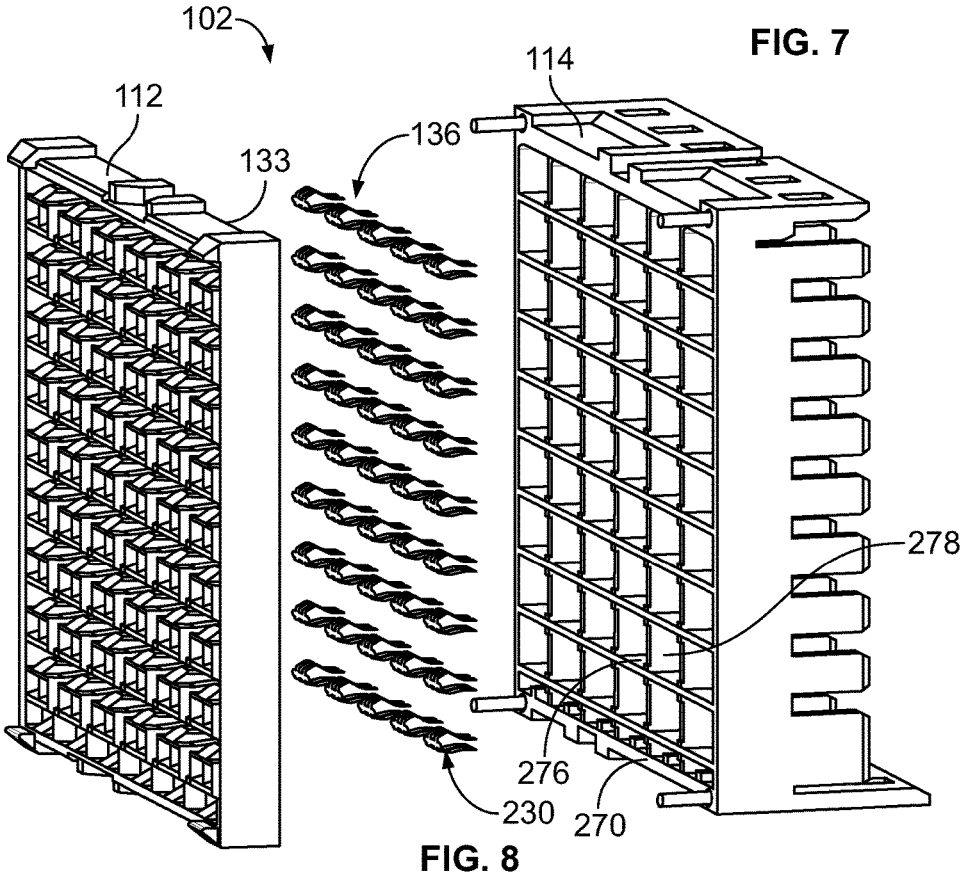
FIG. 8 is a front, exploded view of a portion of the receptacle connector assembly in accordance with an exemplary embodiment.

FIG. 8 is a front, exploded view of a portion of the receptacle connector assembly 102 showing the front shell 112 and the rear shell 114 with the conductors 136 poised for coupling to the rear shell 114. The individual clips 230 shown in FIG. 7 are illustrated in FIG. 8. The clips 230 are configured to be coupled to the horizontal and vertical separator walls 276, 278 at the corresponding locations. The front shell 112 is illustrated as having a planar rear 133 and the rear shell 114 is illustrated as having a plate or front 270 configured to be mated to the rear 133 of the front shell 112. The front shell 112 may be secured to the rear shell 114 by adhesive or by other fastening means, such as clips, latches, fasteners, and the like.

Optionally, the rear shell 114 may be manufactured from a different material as the front shell 112. For example, the front shell 112 may be manufactured from a dielectric material and the rear shell 114 may be manufactured from a conductive material. For example, the rear shell 114 may be die cast. Alternatively, the rear shell 114 may be a plated plastic having one or more surfaces that are plated with conductive material. The conductive material of the rear shell 114 may define conductors 136 of the receptacle connector assembly 102.

Figure 9:
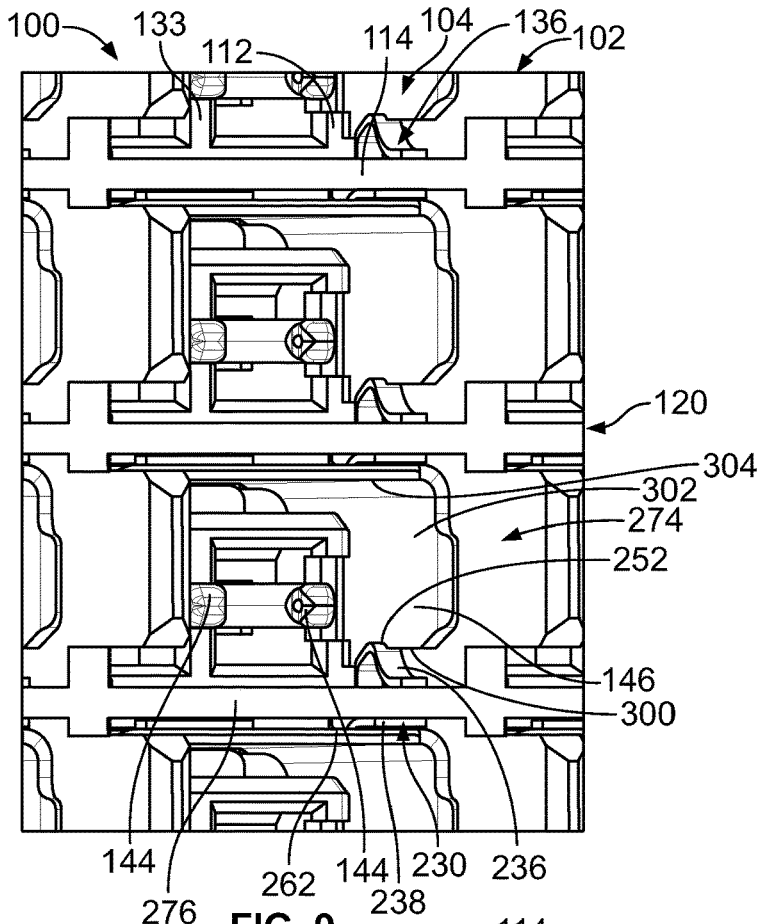
FIG. 9 is a perspective view of a portion of the electrical connector system showing the receptacle connector assembly and the header connector assembly in accordance with an exemplary embodiment.

FIG. 9 is a perspective view of a portion of the electrical connector system 100 showing the housing 120 of the receptacle connector assembly 102 and the header connector assembly 104 coupled to the housing 120 of the receptacle connector assembly 102. The contact modules 122 (shown in FIG. 2) are removed for clarity to illustrate the positioning of the header signal contacts 144 and the header ground contacts 146 in the housing 120. FIG. 9 illustrates the conductors 136 electrically connected to the header ground contacts 146.

The pockets 274 are configured to receive the ends of the header signal contacts 144 and the header ground contacts 146. For example, the ends of the header signal contacts 144 and the header ground contacts 146 extend rearward of the rear 133 of the front shell 112. The upper mating beams 236 and the lower mating beams 238 of the clips 230 extend along the separating walls 276 in the pockets 274. The mating interfaces 252, 262 are oriented in the pockets 274 to engage the header ground contacts 146. For example, the mating interfaces 252 of the upper mating beams 236 engage edges 300 of the sidewalls 302 of the header ground contacts 146. The mating interfaces 262 of the lower mating beams 238 engage the end walls 304 of the header ground contacts 146. As such, each clip 230 is configured to engage two different header ground contacts 146, such as the header ground contact 146 in the upper pocket 274 above the corresponding separator wall 276 and the header ground contact 146 in the lower pocket 274 below the corresponding separator wall 276. The mating interfaces 252, 262 of the mating beams 236, 238 engage the header ground contacts 146 along the length of the header ground contacts 146, such as remote from the distal ends of the header ground contacts 146 and remote from the opposite ends of the header ground contacts 146, such as the ends that are mounted to the circuit board 108 (shown in FIG. 1). The mating beams 236, 238 are electrically coupled to the header ground contacts 146 within the receptacle connector assembly 102. For example, the location of the mating interfaces 252, 262 is interior of the rear shell 114. The mating interfaces 252, 262 engage the header ground contacts 146 at a location rearward of the front 131 (shown in FIG. 2) of the front shell 114. In various embodiments, the header ground contacts 146 may be electrically common outside of the receptacle connector assembly 102, such as at the circuit board 108 and/or within the header connector assembly 104 forward of the front shell 112; however, the conductors 136 electrically common the header ground contacts 146 at a different, downstream location, such as proximate to the distal ends of the header ground contacts 146. Optionally, the location where the mating beams 236, 238 engage the header ground contacts 146 is located in the outer half of the header ground contact 146 (for example, between the distal end of the header ground contact 146 and the midpoint of the header ground contact 146). The conductors 136 significantly raise the resonance frequency, such as above a target frequency beyond an operating frequency, as the signals pass through the receptacle connector assembly 102, thereby improving crosstalk performance.

Figure 10:
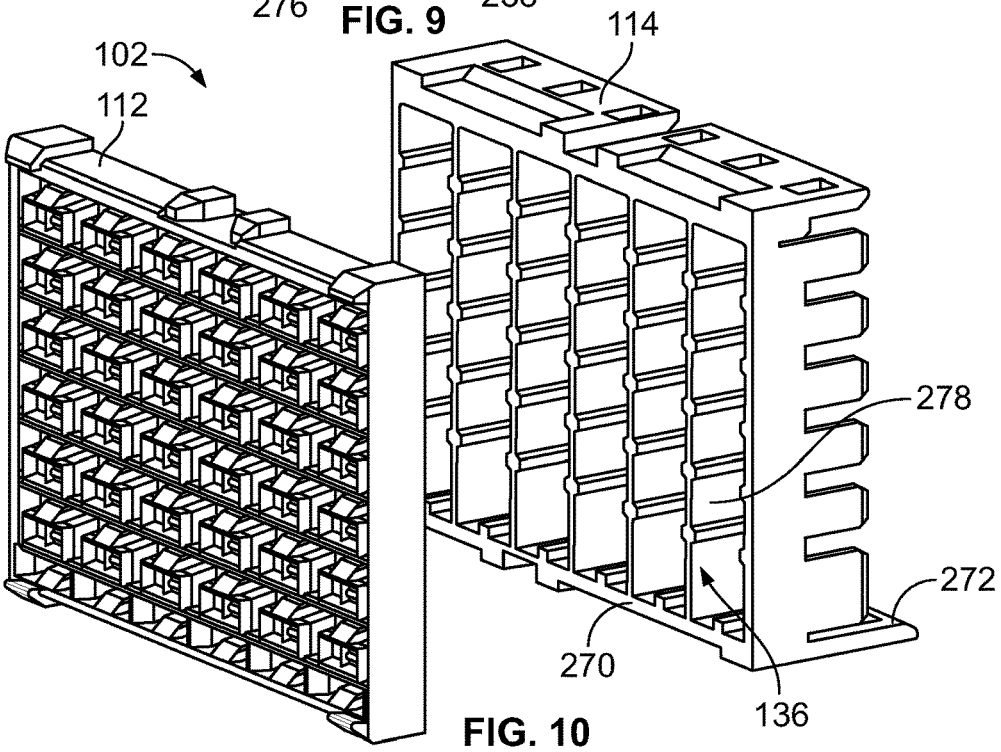
FIG. 10 is a front, exploded view of a portion of the receptacle connector assembly in accordance with an exemplary embodiment.

FIG. 10 is a front, exploded view of a portion of the receptacle connector assembly 102 in accordance with an exemplary embodiment showing the front shell 112 and the rear shell 114. In the illustrated embodiment, the rear shell 114 is conductive and defines the conductors 136. For example, the vertical separating walls 278 are conductive and may electrically couple to the header ground contacts 146 and/or provide electrical shielding in the mating zone. The rear shell 114 may be die cast. Alternatively, the rear shell 114 may be a plated plastic having one or more surfaces that are plated with conductive material. While horizontal separating walls are not shown in FIG. 10, horizontal separating walls may be provided in alternative embodiments. The conductors 136 provide electrical shielding along the entire length between the front 270 and the rear 272 of the rear shell 114. The conductors 136 significantly raise the resonance frequency, such as above a target frequency beyond an operating frequency, as the signals pass through the receptacle connector assembly 102, thereby improving crosstalk performance.

Figure 11:
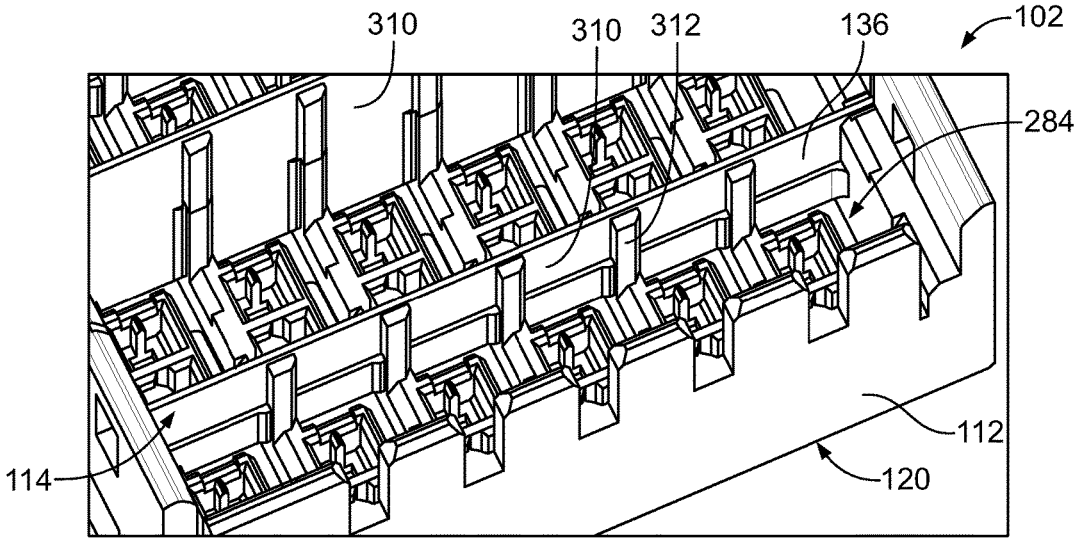
FIG. 11 is a rear perspective view of a portion of the receptacle connector assembly in accordance with an exemplary embodiment.
Figure 12:
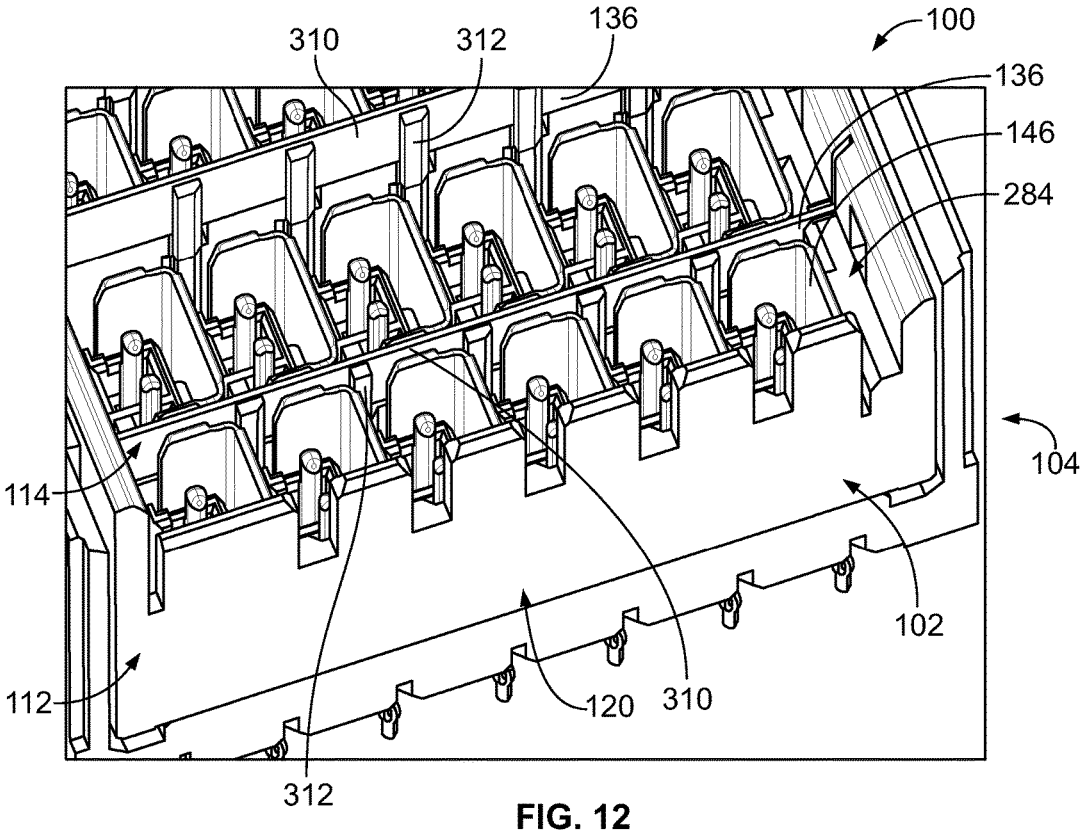
FIG. 12 is a perspective view of a portion of the electrical connector system showing the receptacle connector assembly and the header connector assembly in accordance with an exemplary embodiment.
Figure 13:
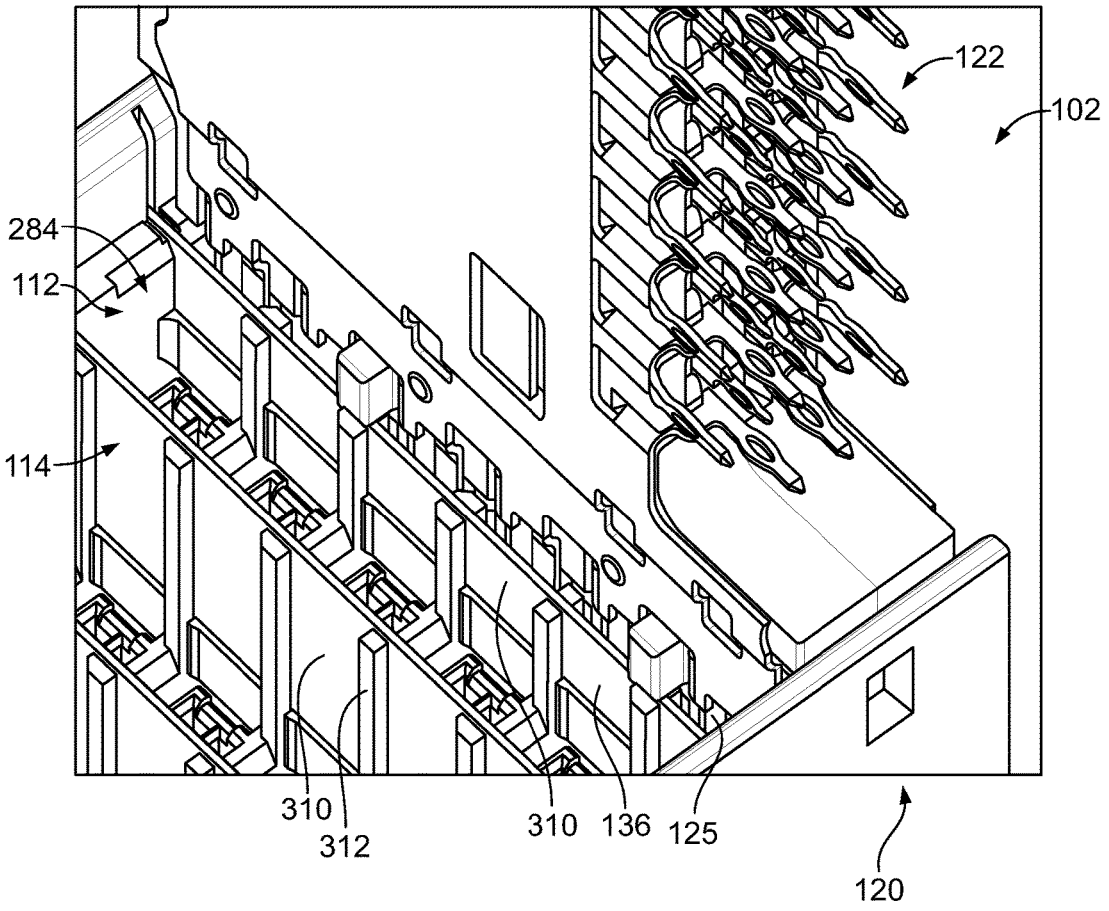
FIG. 13 is a rear perspective view of a portion of the receptacle connector assembly in accordance with an exemplary embodiment.

FIG. 11 is a rear perspective view of a portion of the receptacle connector assembly 102 in accordance with an exemplary embodiment showing the front shell 112 and the rear shell 114. FIG. 12 is a perspective view of a portion of the electrical connector system 100 showing the housing 120 of the receptacle connector assembly 102 and the header connector assembly 104 coupled to the housing 120 of the receptacle connector assembly 102. FIG. 13 is a rear perspective view of a portion of the receptacle connector assembly 102 in accordance with an exemplary embodiment showing the contact module 122 mated with the front shell 112 and the rear shell 114. In the illustrated embodiment, the rear shell 114 is defined by a plurality of conductive plates 310. The rear shell 114 is a multi-piece shell with the separate pieces coupled to the front shell 112 rather than being coupled to each other. The conductive plates 310 are received in the cavity 284 of the front shell 112. In an exemplary embodiment, the front shell 112 includes support beams 312 for supporting the plates 310. The conductive plates 310 provide electrical shielding in the mating zone. The conductive plates 310 may electrically couple to the header ground contacts 146 (FIG. 12) and/or the ground contacts 125 (FIG. 13). The surfaces of the plates 310 are conductive and define the conductors 136. The conductors 136 significantly raise the resonance frequency, such as above a target frequency beyond an operating frequency, as the signals pass through the receptacle connector assembly 102, thereby improving crosstalk performance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector assembly comprising:

at least one contact module having signal contacts and ground contacts; and a housing having a front shell and a rear shell, the front shell having a front and a rear, the rear shell having a front and a rear, the front of the rear shell engaging the rear of the front shell, the rear shell receiving the at least one contact module, the front of the front shell defining a mating end of the housing configured for mating with a header connector assembly, the front shell and the rear shell receiving the signal contacts and configured to receive corresponding header signal contacts of the header connector assembly in mating engagement with the signal contacts in a mating zone, the front shell and the rear shell receiving the ground contacts and configured to receive corresponding header ground contacts of the header connector assembly in mating engagement with the ground contacts in the mating zone, the rear shell having pockets receiving corresponding signal contacts and ground contacts, the rear shell having conductors at the front of the rear shell providing electrical shielding in the mating zone.

2. The connector assembly of claim 1, wherein the conductors are deflectable within the pockets.

3. The connector assembly of claim 1, wherein the conductors include mating interfaces configured to engage corresponding header ground contacts between the front of the rear shell and the rear of the rear shell.

4. The connector assembly of claim 1, wherein the conductors are remote from the front of the front shell.

5. The connector assembly of claim 1, wherein the front shell is dielectric and the rear shell is conductive defining the conductors.

6. The connector assembly of claim 1, wherein the rear shell includes separating walls defining the pockets, the separating walls being conductive.

7. The connector assembly of claim 1, wherein the rear shell includes separating walls defining the pockets, the conductors comprise clips coupled to the separating walls and extending into the pockets.

8. The connector assembly of claim 7, wherein each clip comprises a base and a mating beam extending from the base into the pocket, the mating beam configured to engage the corresponding header ground contact.

9. The connector assembly of claim 7, wherein each clip comprises a base extending along the front of the rear shell, an upper mating beam extending from the base into the pocket above the corresponding separating wall and a lower beam extending from the base into the pocket below the corresponding separating wall, the upper mating beam and the lower mating beam configured to engage different header ground contacts received in the corresponding pockets.

10. The connector assembly of claim 7, wherein each clip comprises a pair of upper mating beams and a pair of lower mating beams, each pair of upper mating beams receiving a corresponding separating wall therebetween, each pair of lower mating beams receiving a corresponding separating wall therebetween.

11. The connector assembly of claim 7, wherein the conductors comprise connecting bars between corresponding clips.

12. The connector assembly of claim 1, wherein the rear shell comprises horizontal separating walls and a vertical separating walls defining the pockets, the conductors comprising clips including bases coupled to the corresponding horizontal walls at the front of the rear shell and the clips including mating beams extending from the bases along the vertical separating walls into the corresponding pockets, the mating beams configured to engage corresponding header ground contacts.

13. The connector assembly of claim 12, wherein the mating beams comprise upper mating beams extending into the pockets above the corresponding horizontal separating wall and lower mating beams extending into the pockets below the corresponding horizontal separating wall.

14. The connector assembly of claim 1, wherein the front shell includes a latching feature and the rear shell includes a latching feature engaging the latching feature of the front shell to secure the front shell to the rear shell.

15. A receptacle connector assembly comprising:

at least one contact module having signal contacts and ground contacts; and a housing having a front shell and a rear shell, the front shell having a front and a rear, the rear shell having a front and a rear, the front of the rear shell engaging the rear of the front shell, the rear shell having separating walls defining pockets, the rear shell receiving the at least one contact module such that the signal contacts and the ground contacts extend into corresponding pockets, the front of the front shell defining a mating end of the housing configured for mating with a header connector assembly, the front shell having signal contact openings receiving corresponding signal contacts and configured to receive corresponding header signal contacts of the header connector assembly in mating engagement with the signal contacts, the front shell having ground contact openings receiving corresponding ground contacts and configured to receive corresponding header ground contacts of the header connector assembly in mating engagement with the ground contacts, the rear shell having clips at the front of the rear shell, the clips being conductive, each clip having a base and a mating beam extending from the base, the mating beam extending into the corresponding pocket and being configured to engage and be electrically coupled to the corresponding header ground contact of the header connector assembly received in the corresponding pocket.

16. The connector assembly of claim 15, wherein the base of each clip extends along the front of the rear shell, the mating beam being an upper mating beam extending from the base into the pocket above the corresponding separating wall, the clip includes a lower beam extending from the base into the pocket below the corresponding separating wall, the upper mating beam and the lower mating beam configured to engage different header ground contacts received in the corresponding pockets.

17. The connector assembly of claim 15, further comprising connecting bars between corresponding clips such that a plurality of clips are ganged together.

18. An electrical connector system comprising:

a header connector assembly having a header housing holding header signal contacts and header ground contacts, the header ground contacts having shield walls extending to distal ends of the header ground contacts; and a receptacle connector assembly having at least one contact module having signal contacts and ground contacts and a housing having a front shell and a rear shell holding the at least one contact module, the front shell having a front and a rear, the rear shell having a front and a rear, the front of the rear shell engaging the rear of the front shell, the front of the front shell defining a mating end of the housing mated with the header housing, the front shell and the rear shell receiving the signal contacts and the ground contacts of the at least one contact module, the front shell and the rear shell receiving the header signal contacts and the header ground contacts of the header connector assembly in mating engagement with the respective signal contacts and the respective ground contacts, the rear shell having pockets receiving corresponding signal contacts and ground contacts, the rear shell having conductors at the front of the rear shell being electrically coupled to the header ground contacts remote from the front of the front shell.

19. The electrical connector system of claim 18, wherein the conductors include mating interfaces engaging corresponding header ground contacts between the front of the rear shell and the rear of the rear shell.

20. The electrical connector system of claim 18, wherein the rear shell includes separating walls defining the pockets, the conductors comprise clips coupled to the separating walls and extending into the pockets.

21. The electrical connector system of claim 20, wherein each clip comprises a base and a mating beam extending from the base into the pocket, the mating beam engaging the corresponding header ground contact.

* * * * *